US005145244A

United States Patent [19]

Kersting et al.

[11] Patent Number: 5,145,244

[45] Date of Patent: Sep. 8, 1992

[54] EASILY DISASSEMBLED FURNITURE

[75] Inventors: Rüdiger Kersting; Rolf Heidemeier, both of Lübbecke, Fed. Rep. of Germany

[73] Assignee: wellcarton R. Kersting GmbH und Co., Löhne, Fed. Rep. of Germany

[21] Appl. No.: 643,402

[22] Filed: Jan. 18, 1991

[30] Foreign Application Priority Data

Jan. 19, 1990 [DE] Fed. Rep. of Germany ... 9000543[U]

[51] Int. Cl.[5] ..... A47B 43/00

[52] U.S. Cl. ..... 312/259; 211/149

[58] Field of Search ..... 312/259, 262, 263, 264; 211/132, 149; 248/174; 108/111

[56] References Cited

U.S. PATENT DOCUMENTS

| | | | |
|---|---|---|---|
| 868,310 | 10/1907 | White et al. | 312/265 |
| 1,519,207 | 12/1924 | Kay | 211/149 X |
| 2,350,280 | 5/1944 | Holtzman . | |
| 2,805,909 | 9/1957 | Derman | 312/259 |
| 4,311,100 | 1/1982 | Gardner et al. | 211/149 X |

*Primary Examiner*—Joseph Falk

*Attorney, Agent, or Firm*—Jordan and Hamburg

[57] ABSTRACT

Furniture which can readily be disassembled has spaced upright side walls, a rear wall connected to the side walls, transverse mounting elements connected to the side walls, and a safeguard holder mounted on the transverse mounting elements and bearing upon the rear wall.

18 Claims, 6 Drawing Sheets

EASILY DISASSEMBLED FURNITURE

The invention is directed to easily disassembled furniture, for example, a shelf of, in particular, corrugated board or a similar foldable material, with essentially upright sidewalls, as well as a furniture corpus comprising a rear wall and with transverse mounting parts, such as insertable bottoms, which can be supported at the sidewalls, can be inserted preferably in sidewalls slots and have angular, added edge pieces.

In such furniture of the previously used type, which forms a shelf with drawers, the whole of the shelf corpus is formed by a single corrugated board blank, which in each case has two main sidewall areas, which can be folded down or in. Slots, into which the angular, added edge pieces of insertable bottoms can be inserted are provided at the surfaces, which form the inner sidewalls in the assembled state. A lid-shaped cap part, which regionally overlaps sidewalls or the front edges of the front and back sides, can be placed from above on the shelf corpus. Admittedly, aside from the insertable bottoms that are to be provided, said cap part provides the furniture a certain stability. On the whole, however, this stability leaves much to be desired. On the whole, this furniture is unstable and not in a position to be exposed to higher loads.

It is an object of the present invention to provide easily disassembled furniture particularly from corrugated board or similar foldable material of the initially named type, for which the furniture parts to be provided can be fixed to one another securely with improved overall stability.

By means of the holding safeguard, which is to be fixed to the transverse mounting part, the rear wall is braced with the transverse mounting part as well as, by way of the attachments of the transverse mounting part on the sidewall, with the latter. By these means, sidewalls, rear wall and transverse mounting parts can be fixed to one another in a stable manner with extremely little expenditure for construction and assembly and without requiring additional, supplementary attachment devices, which can be loosened only with increased handling expense during assembly and disassembly. In addition, owing to the fact that the parts are securely fixed, the load-carrying capacity is increased significantly and the tilting stability of the furniture is improved substantially, so that this furniture, when constructed as a shelf, for example, can be subjected to a load largely to the same degree as conventional furniture, which is produced from wood.

For a further explanation of the invention, reference is made to the following description as well as to the drawing. The following is shown in diagrammatic representation in the drawing.

DESCRIPTION OF THE PREFERRED EMBODIMENTS

Figure 1:
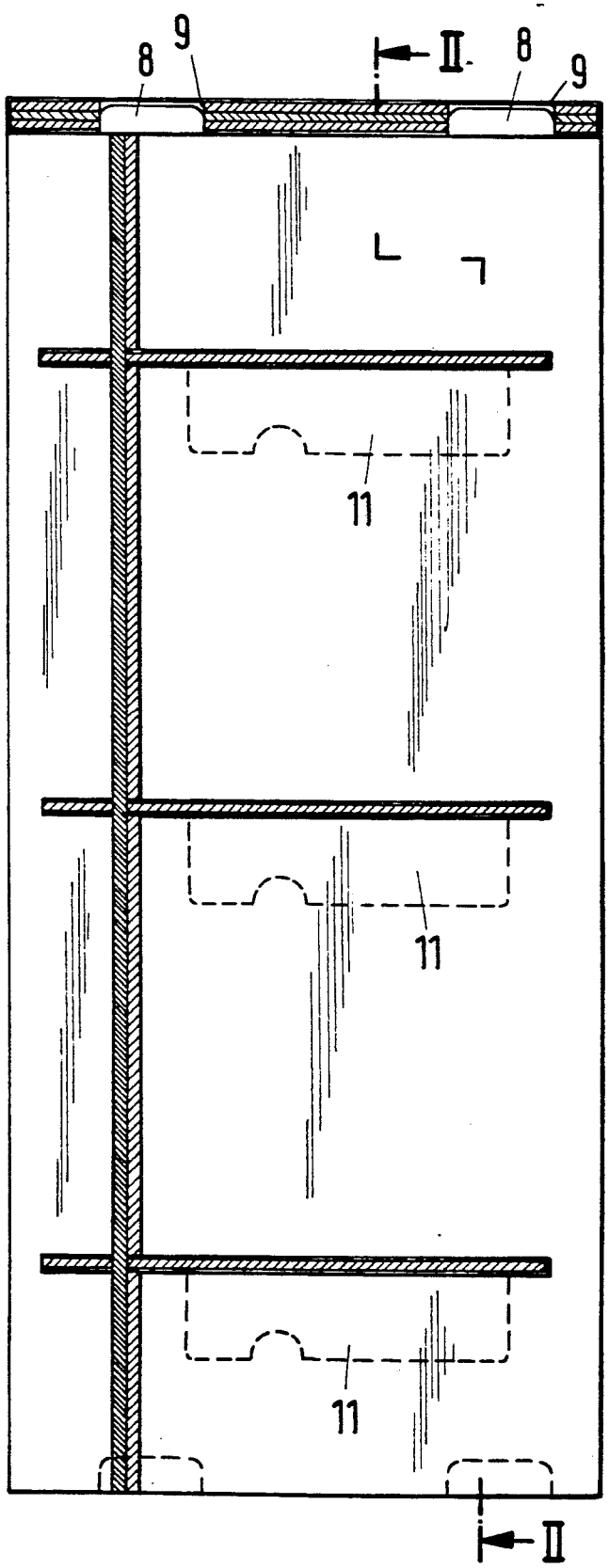
FIG. 1 shows a sectional side view of an example of the operation of the inventive furniture, which is constructed as a shelf.
Figure 2:
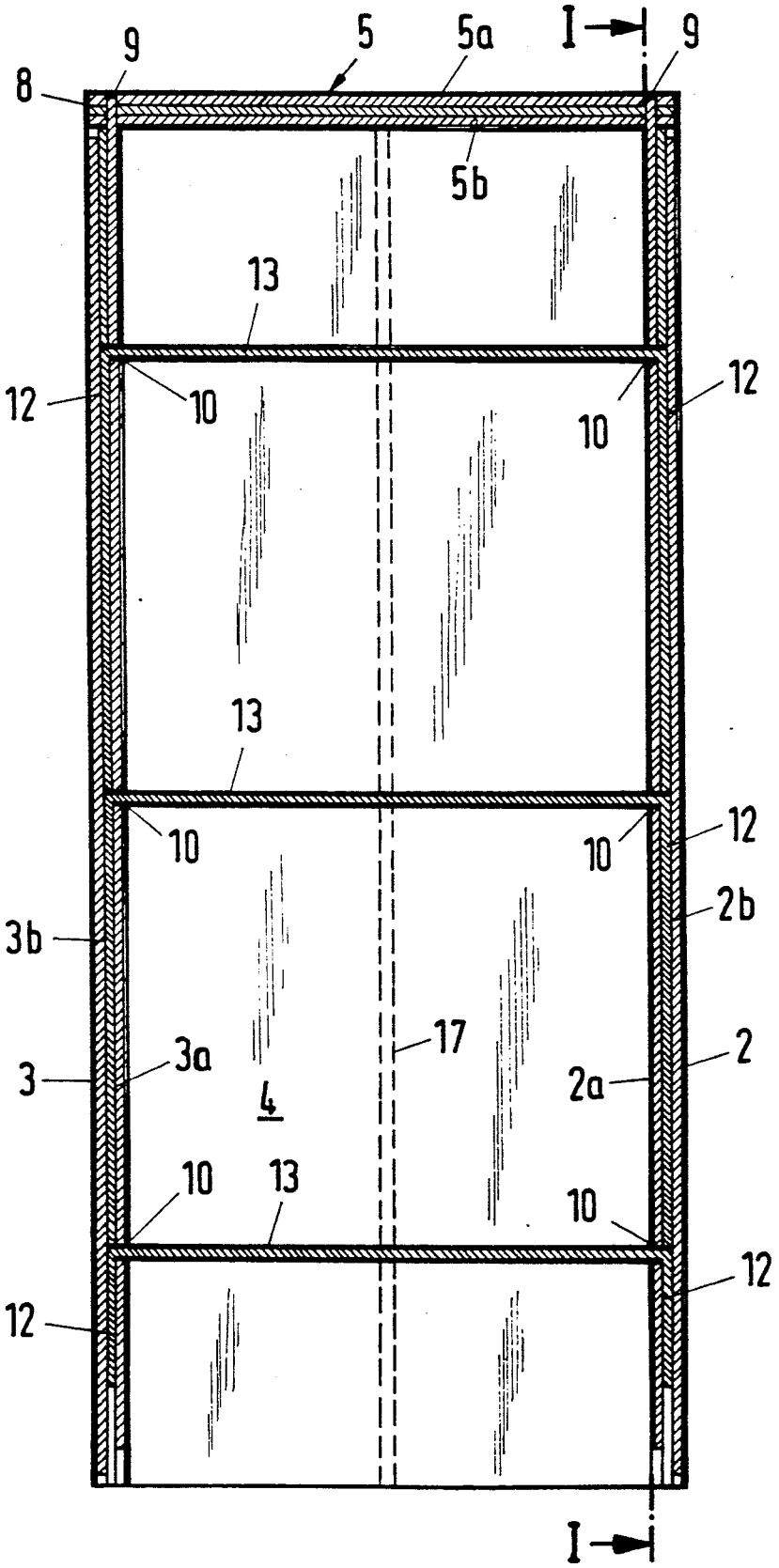
FIG. 2 shows a sectional front view along the line II—II in FIG. 1.
Figure 3:
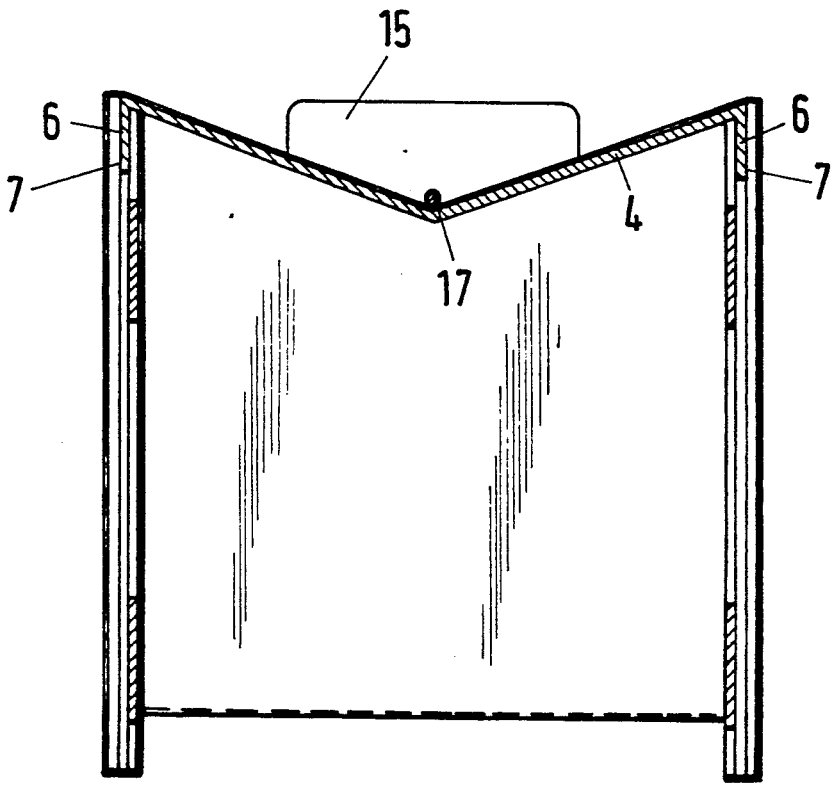
FIG. 3 shows a sectional plan view of the example of the operation shown in FIGS. 1 and 2.
Figure 4:
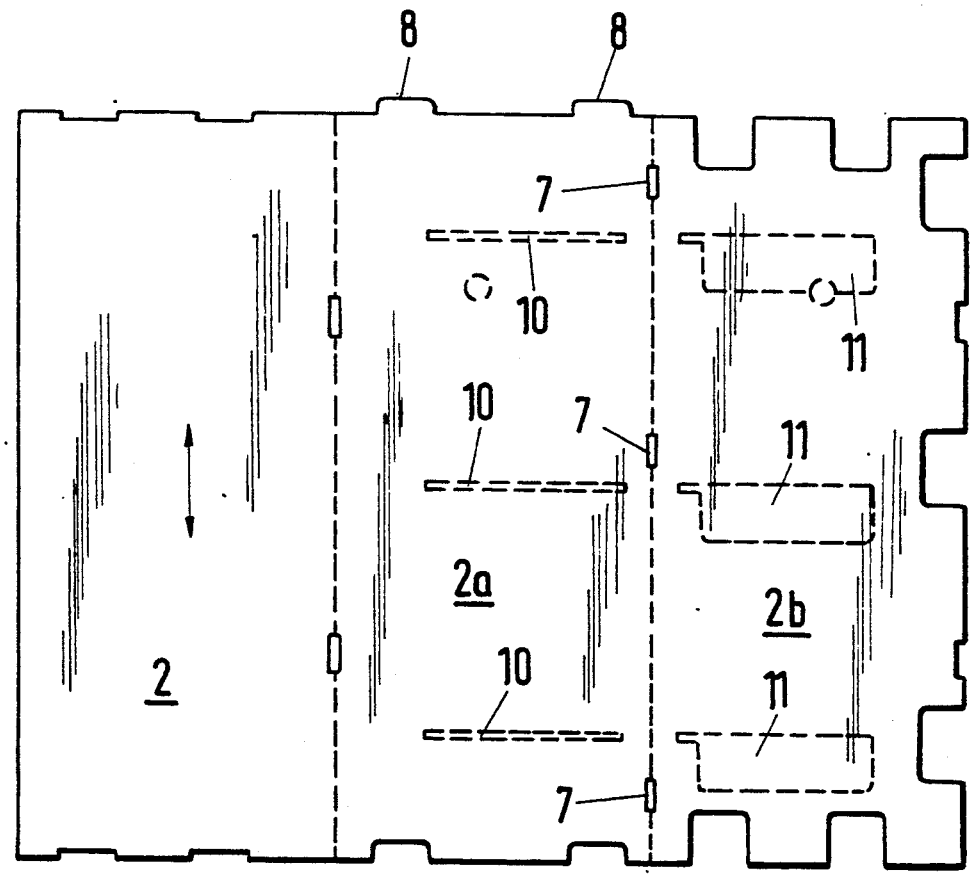
FIG. 4 shows the blank of a sidewall of the example of the operation of FIGS. 1 to 3.
Figure 5:
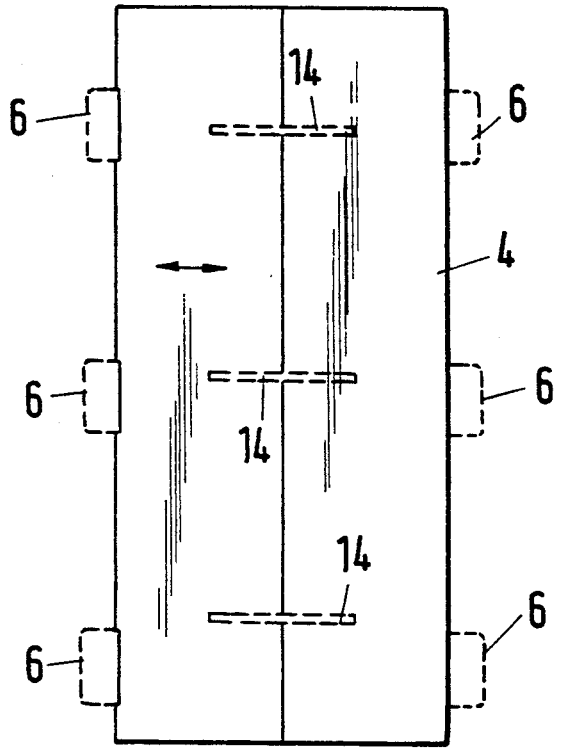
FIG. 5 shows the rear wall blank of the example of the operation of FIGS. 1 to 3.

The furniture, generally labeled 1 in the drawing, is constructed in the example of the operation shown as a shelf, which can easily be disassembled and has a corpus of sidewalls 2 and 3, of a real wall 4, as well as of a lid 5. The sidewalls 2 and 3, as well as the lid 5 are constructed in three layers. On the other hand, the rear wall 4 consists of only one layer of corrugated board. The rear wall 4 has angular added edge pieces 6, which can be inserted from the rear into open recesses 7 of the sidewalls 2 and 3. This is also illustrated in greater detail in FIGS. 4 and 5, which show the corrugated board blanks of the rear wall 4 and of the sidewalls 2 and 3. The blank in FIG. 4 has fold lines 2*x* and 2*y* about which the blank is folded to form the three-layer side walls 2 shown in FIG. 2. The inner layer 2*a* or 3*a* of the sidewalls 2 and 3, which is facing the interior of the corpus in the assembled state, in each case has two added edge pieces 8 (FIGS. 1, 2 and 4), which extends upwards and are to be inserted in the corresponding recesses 9 of the lid 5.

Figure 9:
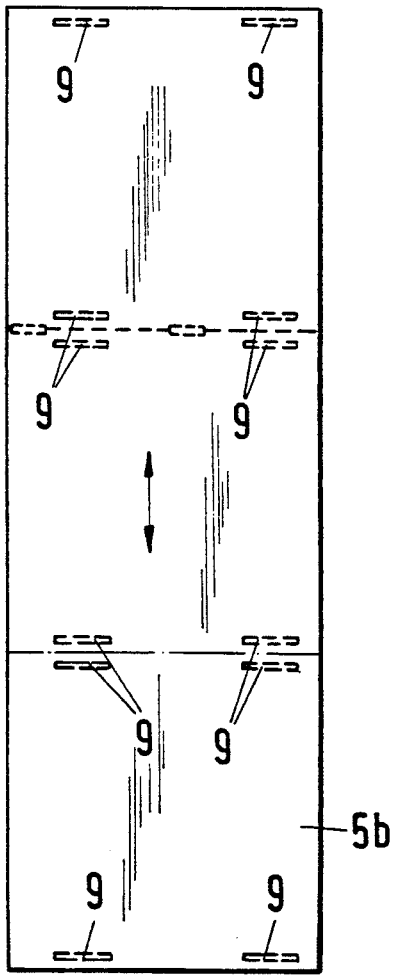
FIGS. 8 and 9 show the blanks for constructing the lid part of the example of the operation of FIGS. 1 to 3.
Figure 8:
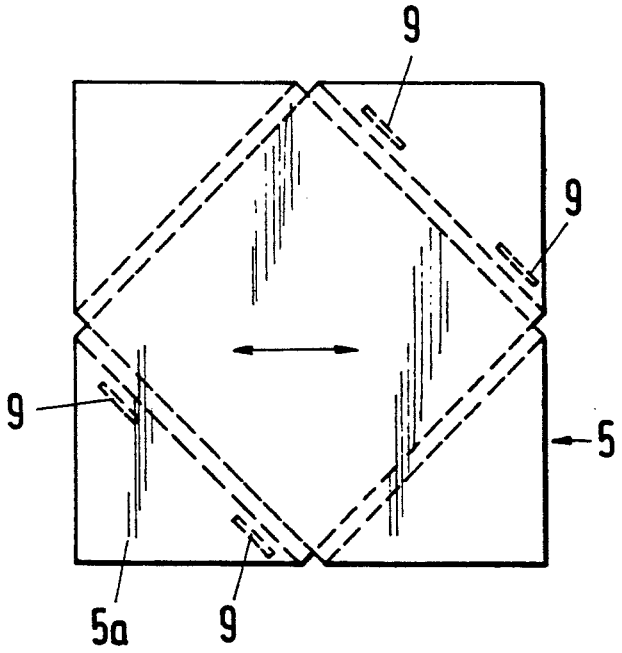

As is illustrated in particular also in FIGS. 8 and 9 of the drawing, the lid 5 consists of a blank 5*a*, which is to be folded in accordance with the broken lines. In the assembled state, the folding-type blank 5*a* forms a covering for the lid to limit an inner 3-layer corrugated board 5*b*, as shown in FIG. 9. The inner board blank can, however, also be constructed in two layers and be enveloped by cardboard, which, in turn, is provided with a printed sheet.

In example 3 of the operation shown, the inner layer 2*a* or 3*a* of the sidewalls 2 or 3, which faces the interior of the corpus in the assembled state, has in each case sidewall slots 10 (FIGS. 2 and 4), which are disposed one above the other and adjoining which there are window-shaped accommodating spaces 11 (FIGS. 1, 2 and 4) in the middle layer 2*b* and 3*b* in the assembled state. Into these accommodating spaces 11, essentially congruently constructed added edge pieces 12 (FIGS. 2 and 6) of transverse mounting pieces 13 forming insertable bottoms are to be inserted in such a manner, that they are bounded and, with that, held securely on both sides by corrugated board layers and also towards the top by the inner corrugated board layers 2*b* or 3*b*.

Figure 7:
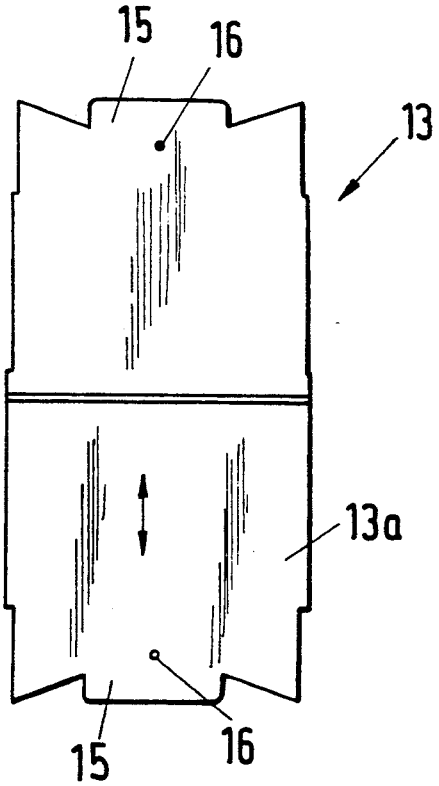
FIGS. 6 and 7 show the blanks for constructing the insertable bottoms for the example of the operation of FIGS. 1 to 3.
Figure 6:
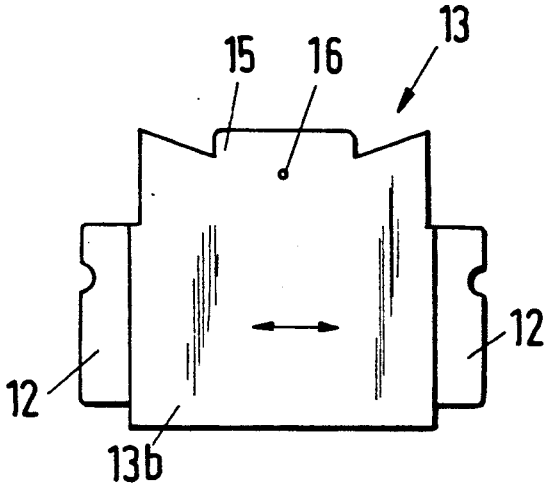

As shown by FIGS. 6 and 7, a transverse mounting part 13 is also formed by a foldable covering 13*a* as well as an inner layer 13*b*, on which there are the added edge pieces 12. Corresponding to the number of transverse mounting parts 13 that are to be provided in the example of the operation, three rear wall slots 14 (FIG. 5), which are disposed one above the other and into which the edge expansions 15 that are provided on the transverse mounting parts 13 are to be inserted, are provided in the rear wall 4. In cross section, the rear wall 4 has a triangular shape that is open towards the rear, so that a rear indentation is formed. The, in the assembled state, rear regions, which adjoin the edge expansions 15 of a transverse mounting part 13, expand at an angle towards the outside and therefore, in the assembled state, follow the course of the triangular cross section of the rear wall 4, so that, outside of the edge expansions 15 that are inserted through the rear wall slots 14, the rear wall 4 ends flush. In the assembled state, the edge expansions 15 have insertion openings 16 in coaxial arrangement. Into these insertion openings 16, a holding safeguard 17, which is constructed, for example, as a wooden rod and which in the assembled state acts upon the rear wall with a gripping power, can be inserted. Taking into consideration the elasticity of the corrugated board chosen in the example of the operation, the parts are designed so that, when assembling the rear wall or the transverse mounting parts, the added edge pieces 12, which are inserted in the sidewalls slots 10, are movable in a particular manner in such a way that the holding safeguard 17 can be mounted and, when mounted, exerts the desired holding force on the rear wall. With that, a holding force, which acts upon the rear wall 4 and the sidewall parts 2 and 3, is also exerted over the added edge pieces 12 in the sidewall slots 10 on the side wall parts 2 and 3. With that and despite of the furthermore existing possibility of once again disassembling the furniture parts with only a few manipulations and without expending much force, the individual parts are connected together securely with the advantage that the furniture is stable and shows no tendency to topple over and can also withstand higher loads. Aside from a rod-shaped holding safeguard, it is of course also possible to provide other holding safeguards, which can be fixed to the transverse mounting parts and act upon the rear wall in an analogous manner with an appropriate holding force. Such other holding safeguards, for example in the form of toe dog components, etc., act upon the rear wall in an analogous manner with an appropriate holding force. By means of the added edge pieces 8, recesses 9, etc., which have been provided, individual furniture elements of the aforementioned type can be strung together almost at will, optionally with the help of suitable connecting elements, stacked and fixed to one another, so that furniture of different height and length, shape and design can be assembled in a technically simple manner.

What is claimed is:

1. Cardboard furniture comprising upright side walls and a rear wall, each of said side walls comprising at least three layers of cardboard including a middle layer disposed between inside and outside layers, an accommodating space between said inside and outside layer, said accommodating space being devoid of said middle layer, said inside layer having an opening communicating with said accommodating space, cardboard transverse mounting elements having side edges juxtaposed to said side walls, said transverse mounting elements having tab sections extending from said side edges, said tab sections passing through said opening in said inside layer and extending into said accommodating space between said inside and outside layers to thereby effect a supporting connection between said transverse mounting element and said side walls.

2. Cardboard furniture according to claim 1, wherein said transverse mounting element has a main planar part from which said tab sections extend, said tab sections being joined to said main part along fold lines which are generally coincident with said side edges of said main part, said main part having edge portions juxtaposed to said fold lines, said opening in said inner layer comprising an elongated slit defined by two spaced elongated slit-defining edges on said inner layer, said edge portions of said main part being disposed between said two spaced elongated slit-defining edges on said inner layer.

3. Cardboard furniture according to claim 2, wherein said accommodating space is defined by an accommodating space edge on said middle layer, said accommodating space edge and said slit-defining edges being disposed in substantially a common plane, said edge portions of said main part being disposed in superimposed relationship with said accommodating space edge.

4. Cardboard furniture according to claim 1, wherein said tab sections are disposed substantially in the same plane as said middle layer.

5. Cardboard furniture according to claim 1, wherein said tab sections have thickness substantially equal to the thickness of said middle layer.

6. Cardboard furniture according to claim 1, wherein said transverse mounting elements are substantially perpendicular to said side walls, said tab sections which extend into said accommodating space being generally parallel to said side walls.

7. Cardboard furniture according to claim 1, wherein said transverse mounting element has a main planar section from which said tab sections extend, said transverse mounting element having an initial unassembled configuration which is substantially flat such that in said initial unassembled configuration said main section and said tab sections are disposed substantially in the same plane.

8. Cardboard furniture according to claim 1, wherein said rear wall is connected to said side walls, said rear wall having an inside and outside, said transverse mounting element having a rear edge juxtaposed to said inside of said rear wall, said transverse mounting element having a rear extending section extending from said rear edge, said rear wall having an opening through which said rear extending section passes to the outside of said rear wall, and holding means being mounted on said rear extending section such that said holding means bears against the outside of said rear wall.

9. Cardboard furniture according to claim 8, wherein said rear wall has an indentation which is directed toward the interior of the furniture, said holding means being juxtaposed to said indentation.

10. Cardboard furniture according to claim 9, wherein said indentation has a generally V-shaped configuration.

11. Cardboard furniture according to claim 8, wherein said rear extending section of said transverse mounting elements have an opening, said holding means extending through said opening.

12. Cardboard furniture according to claim 8, wherein said holding means comprises an elongated rod.

13. Cardboard furniture according to claim 8, wherein there are a plurality of said transverse mounting elements, and said holding means comprises an elongate member which is mounted on each of said transverse mounting elements.

14. A method of making and assembling cardboard furniture comprising the steps of:

providing furniture side walls of at least three layers of cardboard including a middle layer disposed between inner and outer layers;

providing an accommodating space between said inner and outer layers along with an opening in said inner layer communicating with said accommodating space;

providing a cardboard transverse mounting element having an initial unassembled condition including a flat main section with side edges and tab sections coplanar with said main section extending from said side edges;

passing said tab sections through said openings;

inserting said tab sections into said accommodating spaces to an assembled position in which said tab sections are received in said accommodating space; and effecting bending of said tab sections during said insertion step such that said tab sections are transformed from said initial unassembled position coplanar with said main section to said assembled position in which said tab sections are disposed generally perpendicular to said main section.

15. A method of making and assembling cardboard furniture according to claim 14 further comprising disposing said tab sections substantially coplanar with said middle layer when said tab sections are in said assembled position.

16. A method according to claim 14 further comprising disposing said tab sections parallel to said side walls when said tab sections are in said assembled position.

17. A method according to claim 14, wherein said step of providing said furniture side walls of at least three layers comprises initially forming a flat sheet of cardboard material having two parallel fold lines, and folding said flat sheet at said two parallel lines to form said three-layered side walls.

18. A method according to claim 14, wherein said step of inserting said tab sections into said accommodating space comprises inserting said tab sections into said accommodating space such that said side edges of said flat main section are in substantial abutting relationship with said outer layer of said three-layered side walls.

* * * * *